US010513894B2

(12) United States Patent
Abou-Assaad et al.

(10) Patent No.: US 10,513,894 B2
(45) Date of Patent: Dec. 24, 2019

(54) SYSTEMS AND METHODS FOR AUTOMATICALLY OPERATING AN ELECTRO-HYDRAULIC SPIDER

(71) Applicant: Hydril USA Distribution LLC, Houston, TX (US)

(72) Inventors: Amine Mounir Abou-Assaad, Houston, TX (US); Jamie Clay Gamble, Houston, TX (US); Daniel Lynn Carpenter, Houston, TX (US)

(73) Assignee: Hydril USA Distribution LLC, Houston, TX (US)

( * ) Notice: Subject to any disclaimer, the term of this patent is extended or adjusted under 35 U.S.C. 154(b) by 232 days.

(21) Appl. No.: 15/476,372

(22) Filed: Mar. 31, 2017

(65) Prior Publication Data

US 2018/0283112 A1 Oct. 4, 2018

(51) Int. Cl.

| | |
|---|---|
| ***E21B 19/10*** | (2006.01) |
| ***E21B 19/16*** | (2006.01) |
| ***E21B 47/06*** | (2012.01) |
| ***E21B 47/09*** | (2012.01) |

(52) U.S. Cl.

CPC ..... *E21B 19/10* (2013.01); *E21B 19/165* (2013.01); *E21B 47/06* (2013.01); *E21B 47/09* (2013.01)

(58) Field of Classification Search

CPC ..... E21B 19/10; E21B 47/09; E21B 47/06; E21B 19/165

See application file for complete search history.

(56) References Cited

U.S. PATENT DOCUMENTS

| | | | | |
|---|---|---|---|---|
| 6,073,699 | A | 6/2000 | Hollingsworth, Jr. | |
| 7,086,461 | B2 | 8/2006 | Schulze-Beckinghausen et al. | |
| 7,370,707 | B2 | 5/2008 | McDaniel et al. | |
| 8,051,909 | B2 | 11/2011 | Angelle et al. | |
| 8,356,675 | B2 | 1/2013 | Pietras et al. | |
| 2003/0132006 | A1* | 7/2003 | Bussear | E21B 34/10 166/386 |
| 2012/0152530 | A1* | 6/2012 | Wiedecke | E21B 19/07 166/250.01 |

* cited by examiner

*Primary Examiner* — Brad Harcourt
(74) *Attorney, Agent, or Firm* — Hogan Lovells US LLP

(57) ABSTRACT

A method for use in well drilling, development, completion, and production, including supplying hydraulic pressure to a tubing spider having at least one actuating component, generating position data from a position sensor based on the position of the actuating component, generating pressure data from a pressure sensor based on the pressure supplied to the spider, and automatically handling tubing with the spider by actuating the actuating component by adjusting pressure supplied to the spider based on the position data, the pressure data, and a prescribed control algorithm. The method may be implemented as part of a system including a tubing spider having at least one actuating component, sensors detecting hydraulic pressure supplied to the spider and the position of the actuating component, and a programmable logic controller capable of generating spider control data to control the spider based on data from the sensors and a prescribed control algorithm.

20 Claims, 4 Drawing Sheets

SYSTEMS AND METHODS FOR AUTOMATICALLY OPERATING AN ELECTRO-HYDRAULIC SPIDER

FIELD OF INVENTION

This invention relates to methods and systems of operating a tubing spider to handle and couple tubular strings. In particular, the invention is directed to methods and systems to automatically operate a spider electro-hydraulically to handle and couple tubular strings for use in well development, construction, and production, whether offshore or on land.

BACKGROUND OF INVENTION

Long strings of tubular pipe sections ("tubulars") are typically used in the operation of offshore oil and gas wells. These strings are used to drill deep into the earth, in the case of a drill string; to connect the wellhead on the ocean floor to the surface platform and isolate the drill string from the ocean water, in the case of a riser string; to line the wellbore, in the case of a casing string; and to deliver the oil or gas produced from the well to the platform, in the case of a production tube string. These strings can be hundreds or thousands of feet long and made up of hundreds of tubulars joined together, so the process of coupling and decoupling these various tubulars is central to the operation of an offshore well. Land-based wells similarly utilize long tubular strings.

The coupling of tubulars generally occurs by the alternating use of a crane that lowers or supports (an "elevator") and a mechanism through which the tubular string passes that grips and supports the string (a "tubing spider"). As the tubing spider grips and supports the tubular string, the elevator lifts a new length of tubular into alignment with the existing string. Once the new length of tubular is in alignment with the string, the elevator lowers the tubular for coupling to the string and a connection is formed. The elevator, still attached to the tubular, then lifts the entire tubular string to take the weight off the spider, and the spider disengages to release the string. Finally, the elevator lowers the string through the spider by the length of one tubular and the spider once again engages to grip and support the string and the process repeats for as many lengths of tubular as are necessary. Decoupling of the tubular string occurs by the same general process.

Each of the steps of coupling or decoupling a tubular string is traditionally performed by platform workers, often by hand. As a result, the workers may be in close proximity to high pressure fluids and heavy equipment such as the spider, the elevator, and other machinery. This results in a risk of injury to the workers, of damage to the equipment, and of costly production downtime from even minor mistakes. Tubular strings may be customarily "retrieved" and "run" (i.e., entirely dismantled and reassembled) multiple times per year, so these risks can recur throughout the life of a producing well.

Consequently, there is a need for a spider control system that automatically performs the handling, coupling, and decoupling of tubulars without the need for local or remote human input or control.

SUMMARY OF THE INVENTION

One aspect of the present invention relates to an automated electro-hydraulic system for handling tubular strings using a tubing spider. The system includes a hydraulic tubing spider with position sensor generating position data, pressure sensor generating spider pressure data, and actuating component. The spider is capable of retaining, gripping, and holding, collectively referred to as "handling" the tubulars. The system further includes a spider hydraulic control capable of supplying hydraulic pressure from the platform to the spider by way of a spider hydraulic control manifold that regulates the hydraulic pressure provided to the spider by the hydraulic supply. The manifold is coupled with a pressure sensor to generate manifold pressure data and at least one regulator valve to regulate the pressure in the spider hydraulic control manifold and the pressure supplied to the spider. The system may further include a spider electrical control which receives the position, spider pressure data, and manifold pressure data from the spider and manifold through an input module, which automatically processes the position and pressure data into spider control data in a programmable logic controller and power module based on a prescribed control algorithm, and which transmits the spider control data to the regulator valve to operate the spider's handling of tubulars via an output module.

Another aspect of the present invention provides a method for handling tubing using a hydraulic tubing spider for use in well development, construction, and production, whether offshore or on land. The method includes supplying hydraulic pressure to a hydraulic tubing spider having an actuating component, generating position data from a position sensor based on the position of the spider's actuating component, generating pressure data from a pressure sensor based on the pressure supplied to the spider, and automatically handling tubing with the spider by actuating the actuating component by adjusting the pressure supplied to the spider based on the position data, the pressure data, and a prescribed control algorithm.

Yet another aspect of the invention provides a method for coupling or decoupling tubulars into tubular strings that may be used in well development, construction, and production, whether offshore or on land. The system and method may be utilized to either couple or decouple tubulars, so the terms are used interchangeably. The method includes supplying hydraulic pressure to a hydraulic tubing spider having at least one actuating component, from a hydraulic control manifold that includes a manifold pressure sensor, which generates data based on the pressure within the manifold. The spider includes a position sensor which generates position data based on the position of the actuating component and a spider pressure sensor which generates spider pressure data based on the pressure supplied to the spider. These data are transmitted to an input module within a spider electrical control interface which includes an input module, an output module, and a programmable logic controller. The programmable logic controller further comprises a memory, a mass storage device containing a prescribed control algorithm, and a processor. The next steps in the method are to transmit the sensor data to the programmable logic controller from the input module, to use the programmable logic controller to generate control data based on these sensor data and transmitting the control data via the output module to at least one pressure regulator valve positioned to control the hydraulic pressure supplied to the spider. Finally, tubulars are coupled or decoupled with the spider by adjusting the pressure supplied to the spider with the valve based on the control data.

BRIEF DESCRIPTION OF THE DRAWINGS

The present technology will be better understood on reading the following detailed description of non-limiting embodiments thereof, and on examining the accompanying drawings, in which.

DETAILED DESCRIPTION

Figure 1:
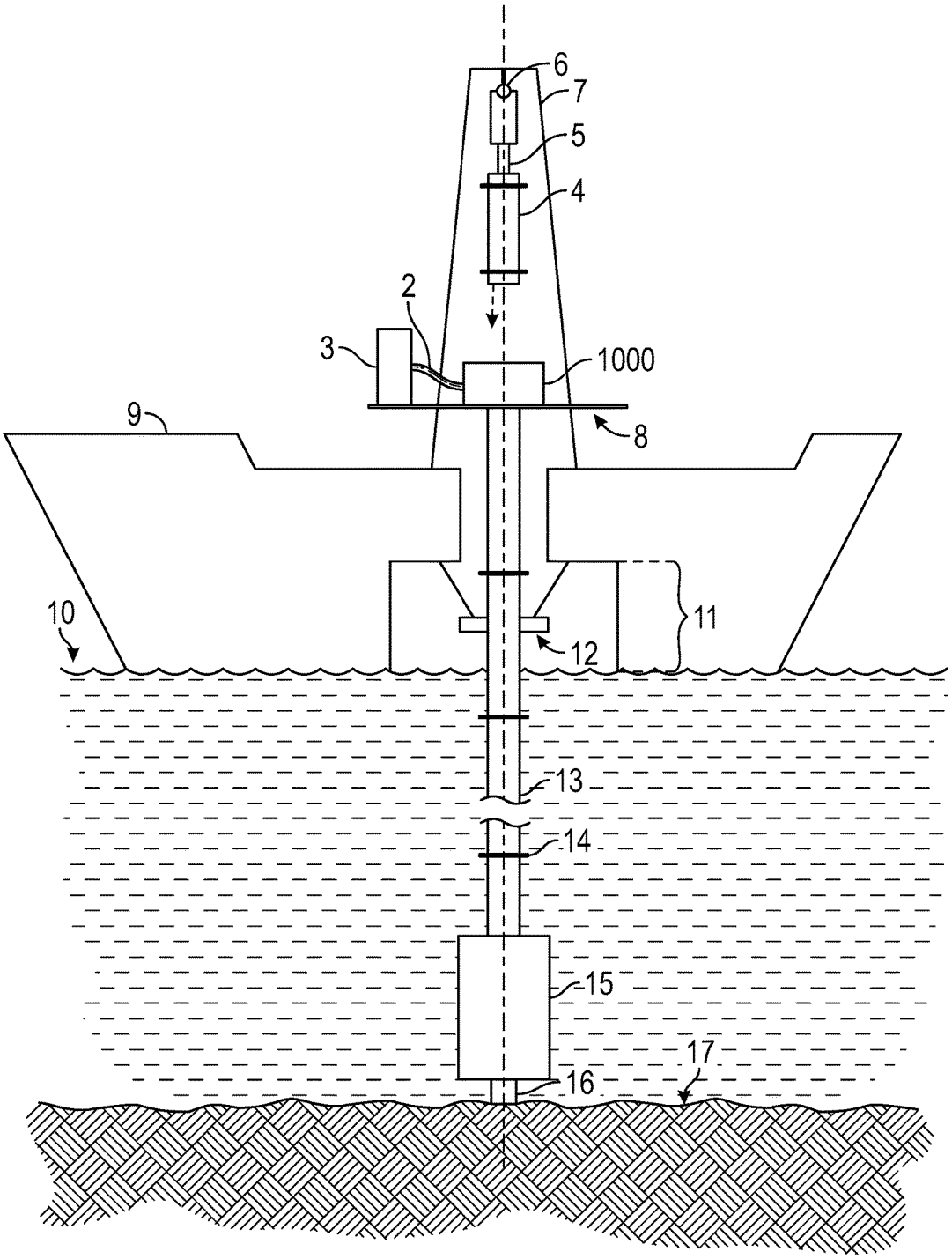
FIG. 1 is a side cross sectional view of a drillship that may be used to implement the automated system or method.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The invention, however, is not intended to be limited to the specific terms used, and it is to be understood that each specific term includes equivalents that operate in a similar manner to accomplish a similar purpose.

FIG. 1 shows a side view of a drillship 9 that may be used to implement the system or method described herein. The drillship 9 may include a tubing spider 1000 connected to a driller's control panel 3, either wirelessly or by a wired connection 2. The spider 1000 and control panel 3 may be situated on the drill floor 8 of the drillship 9. A riser tubular 4 may be connected to a riser handling tool 5 supported by the draw-works 6 of the drillship's derrick 7. The tubular 4 may then be lowered into position to be connected to the riser string 13 via the spider 1000 and utilization of the system or method. The riser string 13 may then pass through the drillship's moonpool 11 and below sea level 10. Tensioners 12 may be connected to the riser string 13 from the drillship 9 for stabilization. Riser couplings 14 may be present at the connections between individual tubulars of the riser string 13, and the string 13 may further connect to a blowout preventer 15. The blowout preventer 15 may connect to the wellhead 16 at the sea floor 17 to reduce the likelihood of and optimally eliminate the chance of an uncontrolled release of liquid or gas from the well. The system or method described herein may be implemented on a drillship, a drilling platform, or another structure or vehicle involved in the development, construction, and production of a well, whether offshore or on land.

Figure 2:
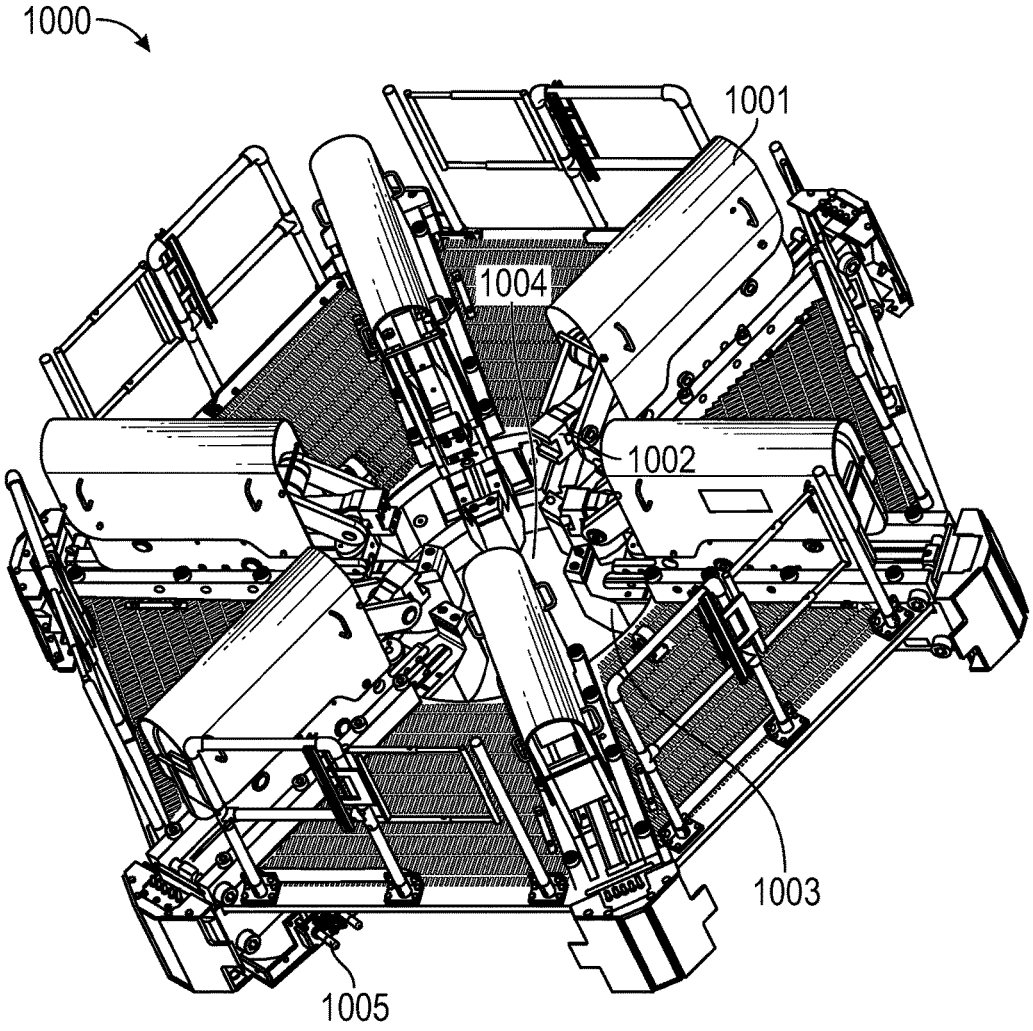
FIG. 2 is an isometric top view of a riser spider that may be used in the automated system or method.

FIG. 2 shows an isometric top view of a tubing spider 1000 that may be utilized in the system or method. The spider 1000 may include a plurality of arm units 1001, each unit containing a horizontal cam-type arm 1002 and a riser support dog 1003. Although the particular spider 1000 shown includes six arm units 1001, more or fewer arm units can be used in alternate embodiments. Pressure sensors 1005 may be arranged to measure the hydraulic pressure supplied to the spider 1000, potentially located on, near, or within the arm units 1001 or dogs 1003. A riser may fit within the center of the spider 1004 and the arm units 1001 and dogs 1003 may be actuated to move radially inward to support the riser as desired, such as when the string is being made up or disconnected.

The position of the arm units 1001, arms 1002, and dogs 1003 may be monitored by position sensors located on, near, or within the spider. Such sensors may be linear or radial variable differential transformers, piezoelectric, incremental encoders, inductive proximity sensors, magnetic inductive, ultrasonic, capacitive, photoelectric, laser measuring, or other varieties of electronic position sensors, such as visual sensors. Based on data generated by the pressure sensors 1005 and the position sensors, the spider 1000 may automatically grip, support, and connect or disconnect a tubular string. The automatic operation of the spider may also be based on position sensors on or near the spider that detect when a tubular string has moved into position for coupling or decoupling. Automatic function of the spider 1000 may create a safer environment for workers and machinery, may reduce the likelihood of error when connecting or disconnecting tubulars, and may increase productivity of the entire rig operation by speeding up the process of making up or breaking down tubular strings.

Additionally, the spider control system or method may be part of a larger control system that coordinates the overall process of making up or breaking a tubular string, including controlling the string elevator and other machinery. The tubing spider of the present technology can be used in drill pipe spiders, spiders used to handle production tubing, and spiders utilized for other tubulars utilized in well drilling, construction, development, and production.

Figure 3:
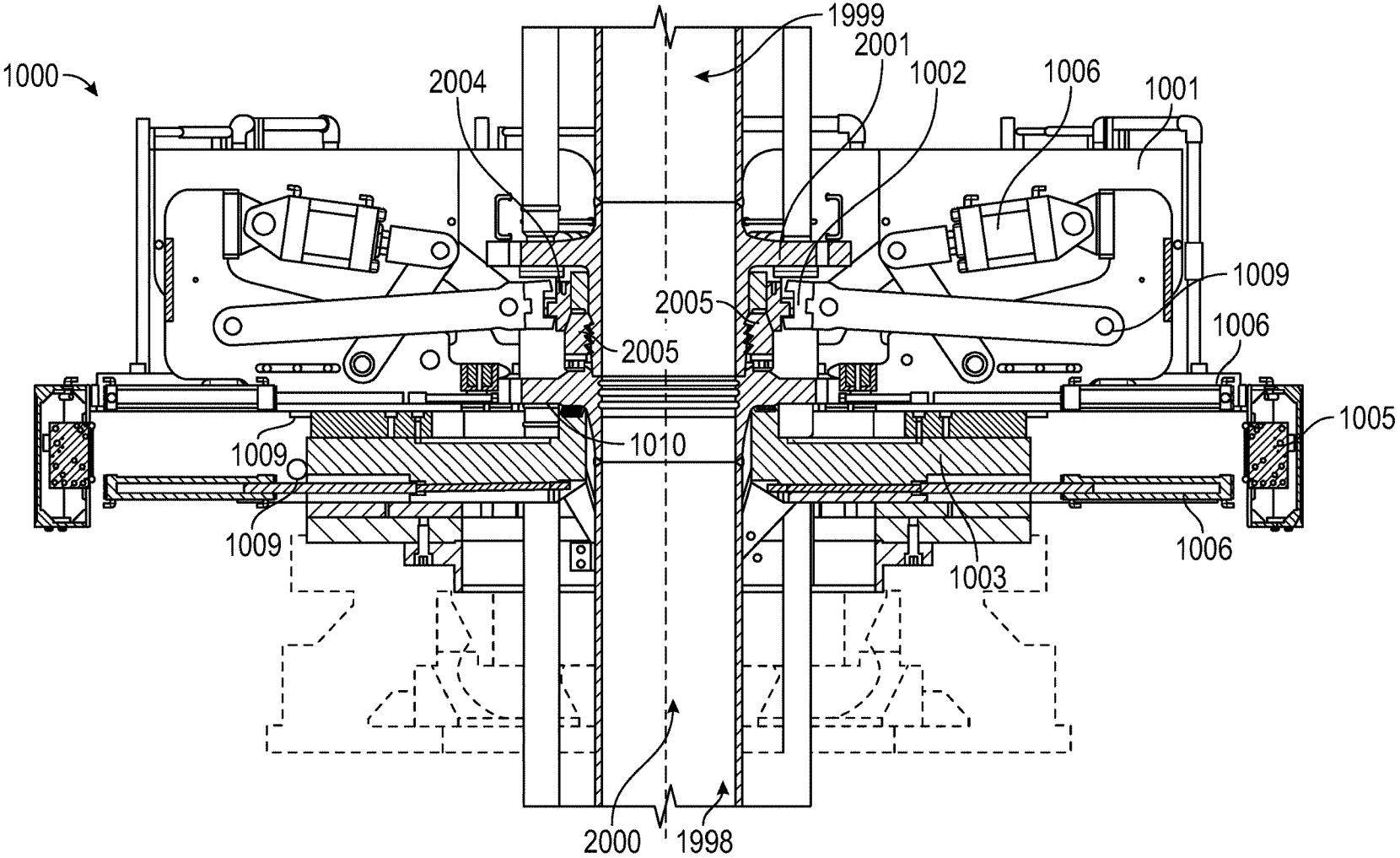
FIG. 3 is a side cross sectional view of a riser spider supporting a riser that may be used in the automated system or method.

FIG. 3 shows a side cross sectional view of a tubing spider 1000 and riser string 2000 that may be utilized in the present system and method. Spider horizontal cam-type arms 1002 are visible within spider arm units 1001. Actuators 1006 may be utilized to actuate the arms 1002 and arm units 1001 radially inward. The actuators may be hydraulic pistons, electro-hydrostatic actuators, or another actuating mechanism. Riser support dogs 1003 are shown engaged to support a riser string 2000, interfacing with the flange 2001 of the bottom riser tubular 1998. An actuator 1006 may also be utilized to actuate the dogs radially inward. Pressure sensors 1005 may be arranged to measure hydraulic pressure supplied to the spider 1000 if hydraulic actuators are used, and in different embodiments can be located on, near, or within the arm units 1001 or dogs 1003, or in multiple different locations.

The spider arms 1002 are depicted making the connection between the riser flanges 2001 of the bottom riser tubular 1998 and the top riser tubular 1999. The arms, actuated by actuator 1006, lower a locking ring 2004 over a compression member 2005 to tighten the compression member around the riser string 2000 and effect a connection of the tubulars.

Position sensors 1009 may be present in the spider arms 1002, along the base of the arm units 1001, or in the dogs 1003 to detect the position of each component. Such sensors may be linear or radial variable differential transformers, incremental encoders, inductive proximity sensors, or other varieties of electronic position sensors, such as visual sensors. Alternatively, the position sensors 1009 may monitor the actuator's 1006 extension to determine the position of each spider component. Based on data generated by the pressure sensors 1005 and the position sensors 1009, the spider may automatically grip, support, and connect or disconnect a tubular string. The automatic operation of the spider may also be based on string position sensors 1010 incorporated into the dogs 1003, the arms 1002, or on or near the spider that detect when a tubular string 2000 has moved into position for coupling or decoupling. These string position sensors 1010 may be pressure-activated switches, electrical position sensors as described above, or proximity sensors using capacitance, induction, magnetism, radar, sonar or ultrasonic, infrared, laser, or optical technology to detect the position of the string 2000. Automatic function of the spider 1000 may create a safer environment for workers and machinery, may reduce the likelihood of error when connecting or disconnecting tubulars, and may increase productivity of the entire rig operation by speeding up the process of making up or breaking down tubular strings.

Figure 4:
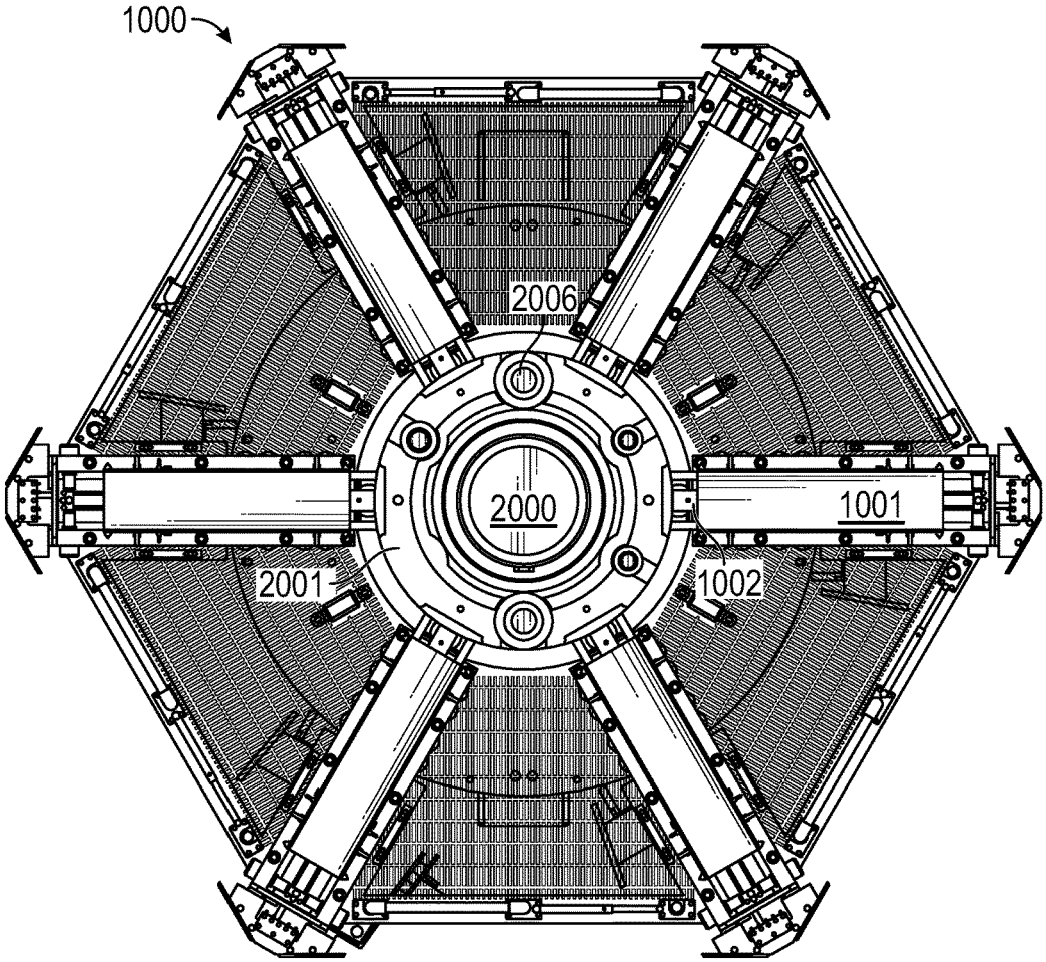
FIG. 4 is a top view of a riser spider supporting a riser that may be used in the automated system or method.

FIG. 4 shows a top view of a tubing spider 1000 and riser string 2000 that may be utilized in the present system or method. The spider arm units 1001 are shown with horizontal cam-type arms 1002 engaged to connect or disconnect the riser string 2000 tubulars. Riser support dogs 2003 are engaged supporting the riser string 2000 by interfacing with riser flange 2001. The riser may have alignment pins 2006 to assist in ensuring each riser tubular is in alignment with the remainder of the riser string 2000 to facilitate making the connection.

The present method or system may be used to effect a connection between tubulars to form a tubular string with a horizontal cam-type spider, as depicted in FIG. 2, FIG. 3, and FIG. 4; a torqueing spider wherein the spider grips the tubulars and applies torque or the spider includes torque wrench mechanisms; or a friction- or compression-based spider including slips that hold a tubular in place.

Figure 5:
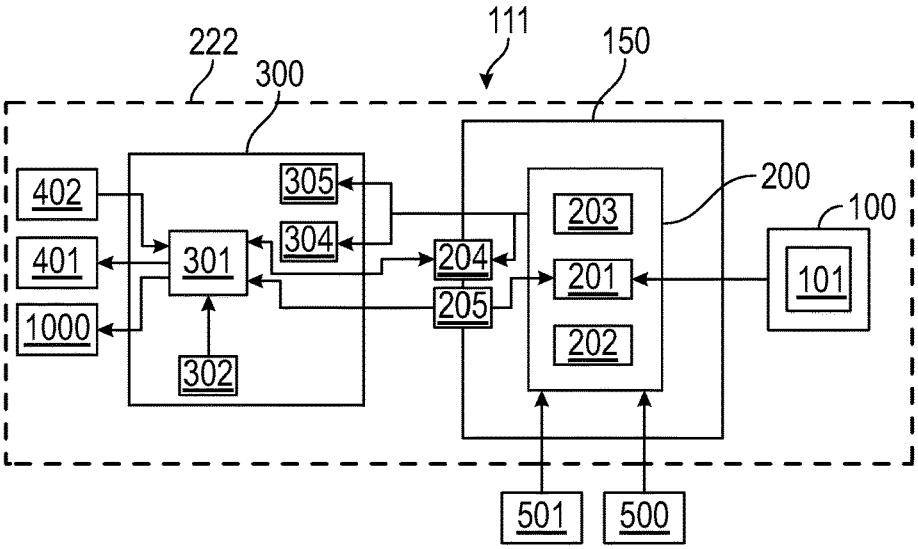
FIG. 5 is a block diagram illustrating how an electro-hydraulic automated spider control system may be arranged.

FIG. 5 shows a block diagram of an electro-hydraulic system 111 for automatic operation of a tubing spider, including a spider 1000, a sensor junction box (J-Box) 100, a spider electrical control interface (I/F) panel 150, and an electro-hydraulic control console 300. The system may safely operate in a Zone 1 Hazardous Area 222, wherein all electrical and hydraulic elements used in the system are rated for use in a Zone 1 Hazardous Area 222, as used in and defined by International Electrotechnical Commission's IEC 60079 series of explosive atmosphere standards. As discussed above, position sensors may be located on the tubing spider 1000 to provide spider position feedback data 101 to an input module 201 through the J-Box 100 via an electrical or wireless connection. Pressure sensors 205 may also be utilized to monitor the pressure supplied to the spider 1000, and optionally the pressure within a spider control manifold 301. These pressure sensors may transmit pressure data to the input module via an electrical or wireless connection. This input module 201 may be housed within in a remote input-output apparatus (Remote I/O) 200 along with an output module 203. The Remote I/O 200 may contain a programmable logic controller and power module (PLC) 202 that interfaces with an electrical power source 501 and interfaces electrically or wirelessly with a driller's control network 500. In certain embodiments, the electrical power source 501 can be attached to and deliver power to the PLC 202, for example, via a power cable, such as a 230 Volt A/C power cable. The driller's control network 500 may be attached to and communicate with the PLC 202 via an optical fiber. The PLC 202 may receive the pressure and position data from the input module 201 and utilize an output module 203 to regulate the hydraulic pressure supplied to the spider 1000 by electrically or wirelessly controlling at least one pressure valve 204. In some embodiments, the pressure valve or valves 204 may be solenoid valves and may additionally or alternatively adjust the pressure within a spider hydraulic control manifold 301 to adjust the hydraulic pressure supplied to the spider 1000. Connection between the output module 203 and the valve or valves 204 can be via a power cable, such as a 24 Volt D/C power cable.

The spider hydraulic control manifold 301 may be housed within an electro-hydraulic control console 300 which receives hydraulic pressure from the rig hydraulic supply 402, outputs a hydraulic return 401, and causes actuation of the spider 1000. This control console may additionally include a hand operated valve 302 to allow local control of the hydraulic pressure supplied to the spider 1000 and override the PLC 202 control. Connections between the spider hydraulic control manifold 301 and each of the solenoid valve or valves 204, pressure sensors 205, hand operated valve 302, rig hydraulic supply 402, hydraulic return 401, and the spider 1000, can be via hydraulic lines. The electro-hydraulic control console may also contain a fault notification system including LEDs (light emitting diodes) 305 or alarms 304 to visually or audibly alert operators of any system faults, which may be based on data transmitted electrically or wirelessly from the output module 203. In certain embodiments connection between the LEDs 305 and/or alarms 304, and the output module 203 can be via power cable, such as, for example, a 24 Volt DC power cable. Additionally, the spider 1000 may be operated electrically, wherein the spider's 1000 actuating components are not hydraulically actuated and the spider's automatic operation depends on position sensors on the spider or tubular, and a preprogrammed control algorithm.

The spider's automatic coupling or decoupling of the tubulars without human input or control reduces the risk of worker injury and damage to equipment from human error that is otherwise intrinsic in the manual operation of a spider. The Zone 1 Hazardous Area-approved electronics also ensure that an accidental combustion will not occur, which may have been the case if a worker brought unapproved equipment into the area surrounding the spider to connect or disconnect the tubulars. The workers who were previously tasked with connecting or disconnecting tubular strings on a rig may work safely elsewhere on the rig, so the automation of the spider also effectively increases the available workforce and productivity of the rig. The spider may also improve the speed at which a tubular string is run by reducing the time needed to couple or decouple the tubulars. This increased speed is magnified because tubular strings are constructed and deconstructed multiple times during the drilling, development, construction, and production of a well, resulting in significant time savings and productivity gains over time. Further, the consistency of automated machinery allows each tubular to be attached to the string with the same force, strength, or torque, reducing the risk of over- or under-torqueing or tightening a connection, which may otherwise damage the tubulars or worse.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. A method for automatically handling tubing using a tubing spider, the method comprising the steps of:

a) supplying hydraulic pressure to a hydraulic tubing spider with an actuating component;

b) generating spider from a spider position sensor based on the position of the actuating component;

c) generating string position data from a string position sensor directly based on the position of a first tubular, wherein the string position sensor is a sensor selected from a group consisting of: pressure-activated switches, electrical position sensors, and proximity sensors;

d) generating pressure data from a pressure sensor that measures pressure supplied to the spider;

e) automatically handling tubing, including the first tubular, with the spider by actuating the actuating component by adjusting pressure supplied to the spider based on the spider and string position data, the pressure data, and a prescribed control algorithm.

2. The method of claim 1, wherein the string position sensor is incorporated into the spider's actuating component.

3. The method of claim 1, wherein the string position sensor is a proximity sensor positioned to directly detect when the first tubular has moved into position for coupling or decoupling.

4. A method for coupling or decoupling tubulars, the method comprising:

a) supplying hydraulic pressure to a hydraulic tubing spider from a hydraulic control manifold, the manifold comprising a manifold pressure sensor and the spider comprising a spider position sensor, a string position sensor, and a spider pressure sensor;

b) generating spider and string position data with the spider position sensor based on the position of an actuating component of the spider and with a string position sensor based on the position of a first tubular, respectively;

c) generating string position data from a string position sensor directly based on the position of a first tubular, wherein the string position sensor is a sensor selected from a group consisting of: pressure-activated switches, electrical position sensors, and proximity sensors;

d)generating manifold pressure data with the manifold pressure sensor based on the pressure of the manifold;

e) generating spider pressure data with the spider pressure sensor based on the pressure supplied to the spider;

f) transmitting the spider and string position data, the spider pressure data, and the manifold pressure data to an input module in a spider electrical control interface, wherein the spider electrical control interface comprises:

an input module, an output module; and a programmable logic controller, the programmable logic controller further comprising:

a memory, a mass storage device containing a prescribed control algorithm; and a processor;

g) transmitting the spider and string position data, spider pressure data, and manifold pressure data to the programmable logic controller;

h) automatically generating control data with the programmable logic controller based on the prescribed control algorithm, the spider and string position data, the spider pressure data, and the manifold pressure data;

i) transmitting the control data from the output module to a pressure regulator valve, the valve being positioned to control the hydraulic pressure supplied to the spider; and j) coupling or decoupling a plurality of tubulars, including the first tubular, with the spider by adjusting the pressure supplied to the spider with the valve based on the control data.

5. The method of claim 4, wherein step j) is accomplished by a horizontal cam-type arm.

6. The method of claim 4, wherein step j) is accomplished by a torqueing mechanism.

7. The method of claim 4, wherein the string position sensor is incorporated into the spider's actuating component.

8. The method of claim 4, wherein the plurality of tubulars are drill pipe tubulars.

9. The method of claim 4, wherein the plurality of tubulars are production tubulars.

10. An automated system for handling tubulars, the system comprising:

a tubing spider system comprising:

a tubing spider, operable by hydraulic pressure, having an actuating component and capable of handling a plurality of tubulars, including a first tubular;

a spider position sensor, which generates spider position data based on the position of the actuating component;

a string position sensor, which generates string position data directly based on the position of the first tubular, and wherein the string position sensor is a sensor selected from a group consisting of: pressure-activated switches, electrical position sensors, and proximity sensors; and a spider pressure sensor, which generates spider pressure data based on the hydraulic pressure supplied to the spider;

a spider hydraulic control comprising:

a hydraulic supply providing hydraulic pressure to the spider;

a spider hydraulic control manifold that regulates the hydraulic pressure provided to the spider by the hydraulic supply;

a manifold pressure sensor, which generates manifold pressure data based on the pressure of the manifold; and a regulator valve that regulates pressure in the spider hydraulic control manifold and the pressure supplied to the spider.

11. The automated system of claim 10, further comprising:

a spider electrical control, the electrical control comprising:

an input module, which receives the spider and string position data from the spider position sensor, spider pressure data from the spider pressure sensor, and manifold pressure data from the manifold pressure sensor;

a programmable logic controller and power module, which receives the manifold pressure data, the spider pressure data, and the spider and string position data from the input module, and automatically generates spider control data based on the spider and string position data, spider pressure data, and manifold pressure data received from the input module, the programmable logic controller comprising:

a memory;

a mass storage device; and a processor; and an output module, which receives the spider control data from the programmable logic controller and transmits the spider control data to a valve.

12. The system of claim 11, further comprising a manual control that overrides the spider control data.

13. The system of claim 10, further comprising a fault notification system to alert workers in the event of a fault.

14. The system of claim 13, wherein the fault notification system comprises at least one LED and at least one alarm.

15. The system of claim 10, wherein the string position sensor is incorporated into the spider's actuating component.

16. The system of claim 10, wherein the spider's actuating component comprises at least one tubular support dog.

17. The system of claim 10, wherein the spider's actuating component comprises at least one horizontal cam-type arm.

18. The system of claim 10, wherein the spider's actuating component comprises at least one torqueing mechanism.

19. The system of claim 10, wherein the string position sensor is a proximity sensor positioned to directly detect when the first tubular has moved into position for coupling or decoupling.

20. The system of claim 10, wherein the plurality of tubulars include drill pipe tubulars.

* * * * *